United States Patent [19]

Vits

[11] 4,308,984

[45] Jan. 5, 1982

[54] JET-CONVEYOR BOX FOR FLOATINGLY GUIDING A CONVEYED STRIP OR SHEET MATERIAL

[75] Inventor: Hilmar Vits, Leichlingen, Fed. Rep. of Germany

[73] Assignee: Vits Maschinenbau GmbH, Langenfeld, Fed. Rep. of Germany

[21] Appl. No.: 126,365

[22] Filed: Mar. 3, 1980

[30] Foreign Application Priority Data

Mar. 24, 1979 [DE] Fed. Rep. of Germany ..... 2911685

[51] Int. Cl.[3] ..... B65H 17/32

[52] U.S. Cl. ..... 226/97; 226/7

[58] Field of Search ..... 226/7, 95, 97; 34/57 R, 34/57 A, 156

[56] References Cited

U.S. PATENT DOCUMENTS 3,763,571 10/1973 Vits ..... 34/57 A 3,957,187 5/1976 Puigrodon ..... 226/7

*Primary Examiner*—Leonard D. Christian

*Attorney, Agent, or Firm*—Kenyon & Kenyon

[57] ABSTRACT

A jet box is constructed with a guide surface adjoining the slit type jet which includes a substantially plane region and a bent region which defines a bend of 30° to 60° with the plane region. In addition, a plurality of jet holes are disposed along the bend for ejecting additional propelling medium therefrom. The jet box may be provided with a slit-type jet formed of a plurality of laterally disposed orifices. In this case, an additional row of jet holes are provided in staggered relation to the jet holes in the bend between the plane and bent regions of the guide surface.

11 Claims, 6 Drawing Figures

JET-CONVEYOR BOX FOR FLOATINGLY GUIDING A CONVEYED STRIP OR SHEET MATERIAL

This invention relates to a jet-conveyor box for floatingly guiding a conveyed strip or sheet material.

Heretofore, it has been known to use various types of jet-blast conveyor boxes in order to guide a strip or sheet material along a conveyed path. Generally, these boxes have a slit-type jet composed of a single continuous slit orifice or a row of discrete laterally adjacent slit orifices and a guide surface adjoining the jet to guide and direct a propelling medium which is ejected through the jet. In addition, these boxes are provided with jet holes at or near the opposite edge of the guide surface relative to the jet in order to eject additional propelling medium.

As described in German Pat. No. PS 1 774 126, the guide surface may have a slightly convex curvature in the direction of conveyance while the jet holes are arranged in several rows in such a way that the propelling medium impinges substantially vertically on the material being conveyed. In this case, the pushing force pattern or behavior of this type of jet box, that is, the force applied by the ejected medium to the material measured in relation to the distance between the material and the box follows a generally hyperbolic curve. However, in the regions which are near the box, the pushing force increases only very slowly with an increasing approach of the material to the box to a peak which is not particularly high whilst likewise decreasing rather slowly to zero away from the box.

Accordingly, it is an object of the invention to provide a jet conveyor box which is characterized by a pushing force curve which rises very steeply in the immediate vicinity of the box to reach a high peak while having a shallow or flat form which quickly drops to zero in the direction away from the box.

It is another object of the invention to reduce the size of the conveyor boxes.

It is another object of the invention to provide a jet conveyor box of relatively small size for cnveying strip or sheet materials.

Briefly, the invention provides a jet conveyor box for floatingly guiding a conveyed strip of material which is constructed with a slit-type jet having at least one orifice for ejecting propelling medium therefrom and a guide surface adjoining the slit-type jet for guiding and directing the medium ejected through the jet. The guide surface includes a substantially plane region adjacent the jet and a bent region disposed at an angle of from 30° to 60° relative to the plane region on a side opposite the jet to define a bend therewith. In addition, a plurality of jet holes are disposed along the bend for ejecting additional propelling medium.

During operation of the jet box, it is possible to obtain a pushing force curve which rises very steeply in the immediate vicinity of the box to reach a high peak while having a shallow or flat form which quickly drops to zero in the direction away from the box. This means that the propelling medium is more efficiently used than before. Consequently, the material can be floatingly conveyed with less energy. This, in turn, means that the jet box may be of a smaller size than was hitherto customary.

In order to achieve optimum conditions, a number of provisions may be applied singly or, preferably, in combination. For example, further jet holes may be provided in the plane region of the guide surface in the vicinity of the bend and, more particularly, in staggered formation relative to the other jet holes.

Jet boxes according to the present invention are particularly well adapted for application on both sides of the conveyed strip or sheet material. In this case, an arrangement is preferred wherein the plane guide surface regions of those boxes which are arranged on one side of the conveyed path of the material extend in a plane which is spaced by a distance of less than double the width of the jet from the corresponding plane in which extend the plane guide surface regions of the jet boxes which are arranged on the opposite side of the material path. The boxes are also offset from each other in the direction of conveying a distance equal to one-half their spacing distance. Such a close spacing of the boxes is indeed possible due to the improved prevention of contact combined with the steady and flutter-free guidance provided by the jet boxes. In actual fact, the spacing distance may be zero, or even negative, i.e. the upper jet boxes may plunge, or dip, slightly into the spaces between the lower jet boxes. In that event, e.g. for drying an offset-printed strip material, the material is so firmly guided that the formerly normally observed longitudinal waves or corrugations due to variations in thickness of superficial color application and moisture are ironed, i.e. flattened out. This eliminates a particularly serious disadvantage of roller-offset printing as compared with intaglio or photogravure printing.

These and other objects and advantages of the invention will become more apparent from the following detailed description and appended claims taken in conjunction with the accompanying drawings in which:

Figure 1:
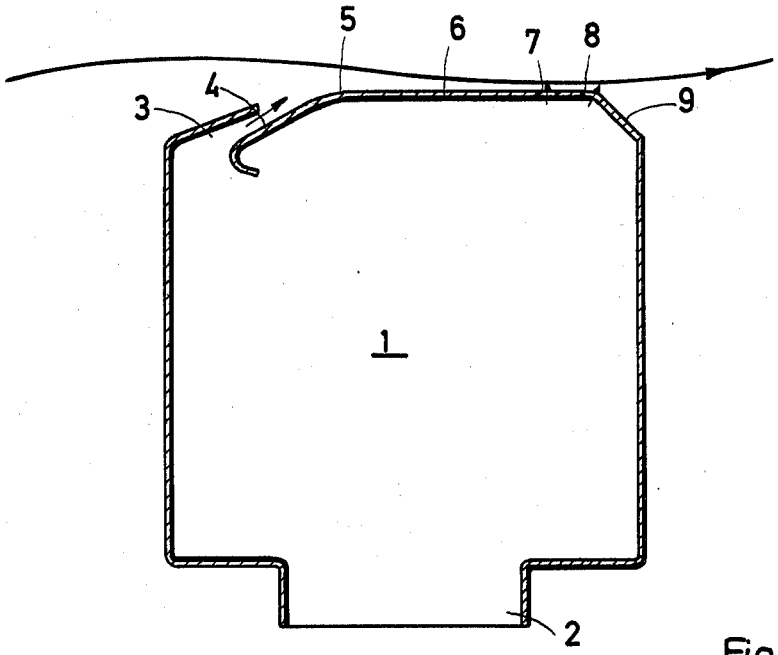
FIG. 1 illustrates a cross-sectional view of a jet box in accordance with the invention provided with a slit-type jet having a single continuous slit orifice.

Referring to FIG. 1, the jet conveyor box 1 is disposed for floatingly guiding a conveyed strip of material in the direction indicated by the arrow. The jet box 1 has a feed pipe 2 for receiving a propelling medium from a suitable source (not shown). The propelling medium may be, for example air, and notably hot air for drawing the material which is floatingly conveyed above the jet box 1.

Figure 2:
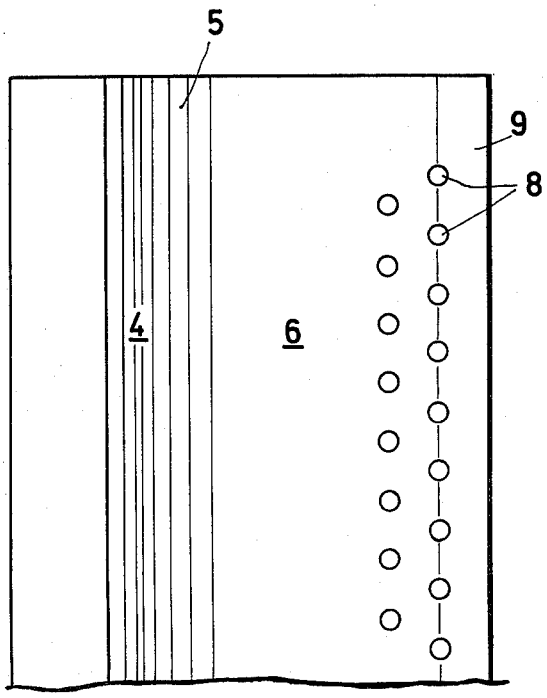
FIG. 2 illustrates a top view of one end of the jet box according to FIG. 1.

Referring to FIGS. 1 and 2, the upper surface of the jet box 1 has a slit-type jet 3 through which the propelling medium is ejected in an obliquely angled direction towards the material. One lip 4 of the jet 3 is extended through a curve or domed region 5 into a substantially level or plane region 6 of a guide surface adjoining the jet 3. This guide surface serves to guide and direct the propelling medium which is ejected through the jet 3. In addition, the guide surface has a bent region 9 disposed on a side of the plane region 6 opposite the jet 3. This bent region 9 is disposed at an angle of from 30° to 60°, for example 45°, relative to the plane region 6 in order to define a bend or bending edge therewith.

In addition, the jet box 1 has a plurality of jet holes 7, 8 directed towards the conveyed material. These holes are disposed in two rows which are mutually parallel and extend along the length of the jet box 1. One row of jet holes 7 is formed in the plane region 6 of the guide surface while the second row of jet holes 8 is arranged precisely along the bend between the plane region 6 and bent region 9. The holes 7, 8 are also offset or staggered relative to each other by one-half the jet hole spacing distance. As a result of the hole arrangement, propelling medium is ejected from the holes 8 at an angle relative to the direction of ejection from the holes 7.

As an example, a jet box 1 constructed for application to typing and printing paper would have the following dimensions. The width of the jet box is 80 millimeters. The hole diameter of jet holes 7,8 is 3 millimeters. The clear width of the slit orifice of the jet 3 is also 3 millimeters. The distance between jet holes 7 and 8 is approximately treble their hole diameter, e.g. 10 millimeters. The jet 3 is spaced from the two rows of jet holes 7, 8 by a distance of 45 millimeters. The blasting direction of jet 3 includes an angle of approximately 25° with the plane region 6 of the guide surface. The bent guide surface region 9 includes an angle of approximately 45° with the plane guide surface region 6.

It is to be noted that the plane region 6 may have a very gently curved surface instead of being flat.

Figure 3:
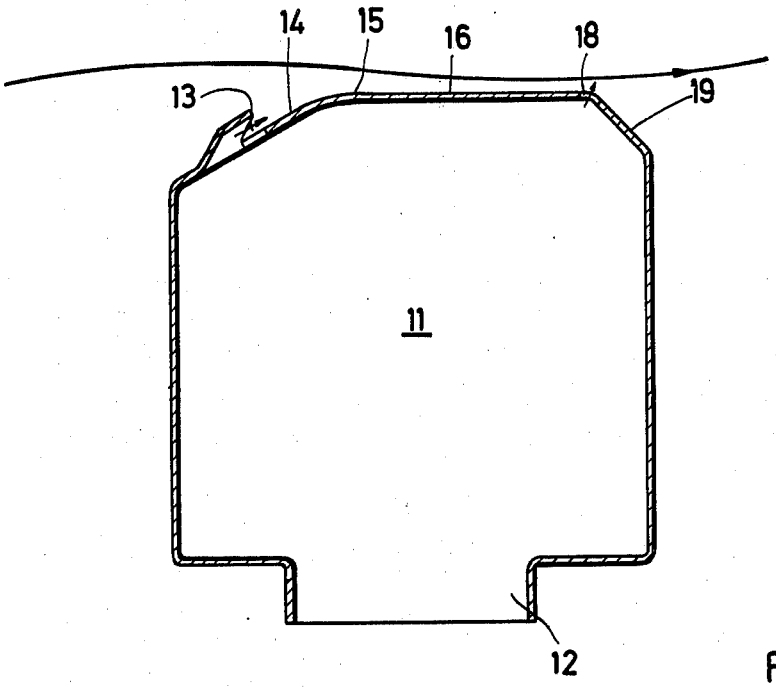
FIG. 3 illustrates a cross sectional view of a jet box according to the invention provided with a slit-type jet having a plurality of discrete laterally adjacent slit orifices.
Figure 4:
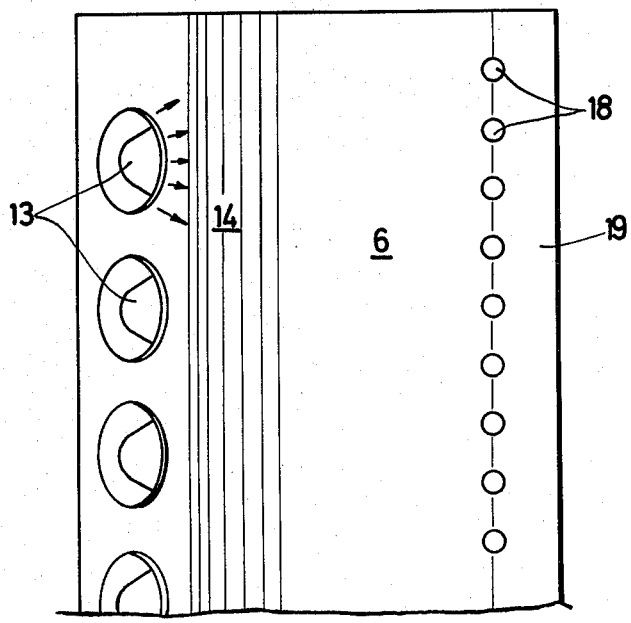
FIG. 4 illustrates a top view of one end of the jet box according to FIG. 3.

Referring to FIGS. 3 and 4, like parts as above have been designated with a prefix "1". As illustrated, the jet box 11 differs from the jet box 1 of FIGS. 1 and 2 in having a jet 13 comprised of a plurality of discrete arcuate slit openings through which the propelling medium is ejected in an outwardly diverging stream. The inclined arcuate slits are made by incisions in the inclined wall of the jet box 11 and by a subsequent pushing out of the resulting arcuate lid parts. This jet box 11 also has only a single row of jet holes 18 along the bend between the regions 16, 19 of the guide surface.

Figure 6:
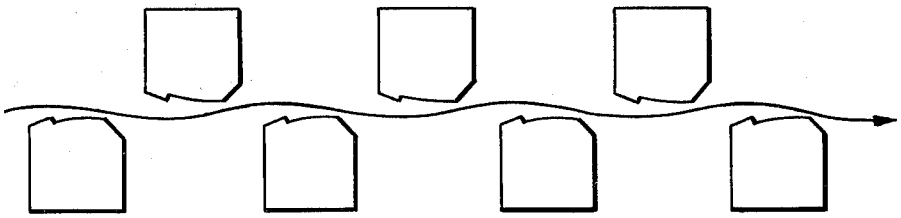
FIG. 6 schematically illustrates an array of upper and lower jet blast boxes for floatingly conveying a strip or sheet material in accordance with the invention.

Referring to FIG. 6, a plurality of jet conveyor boxes may be disposed in longitudinally spaced relation on alternating sides of a conveying path of a strip or sheet of material. In this regard, the plane regions of the boxes on one side of the path extend in a plane spaced a distance less than double the width of a jet from a corresponding plane on the other side of the path containing the plane regions of the boxes thereat. Further, as shown, the boxes on opposite sides of the conveying path are offset from each other a distance equal to one-half the spacing between the boxes on each side of the path. The delivery angle of the jet orifices (3, 13) points in the direction of conveyance.

Figure 5:
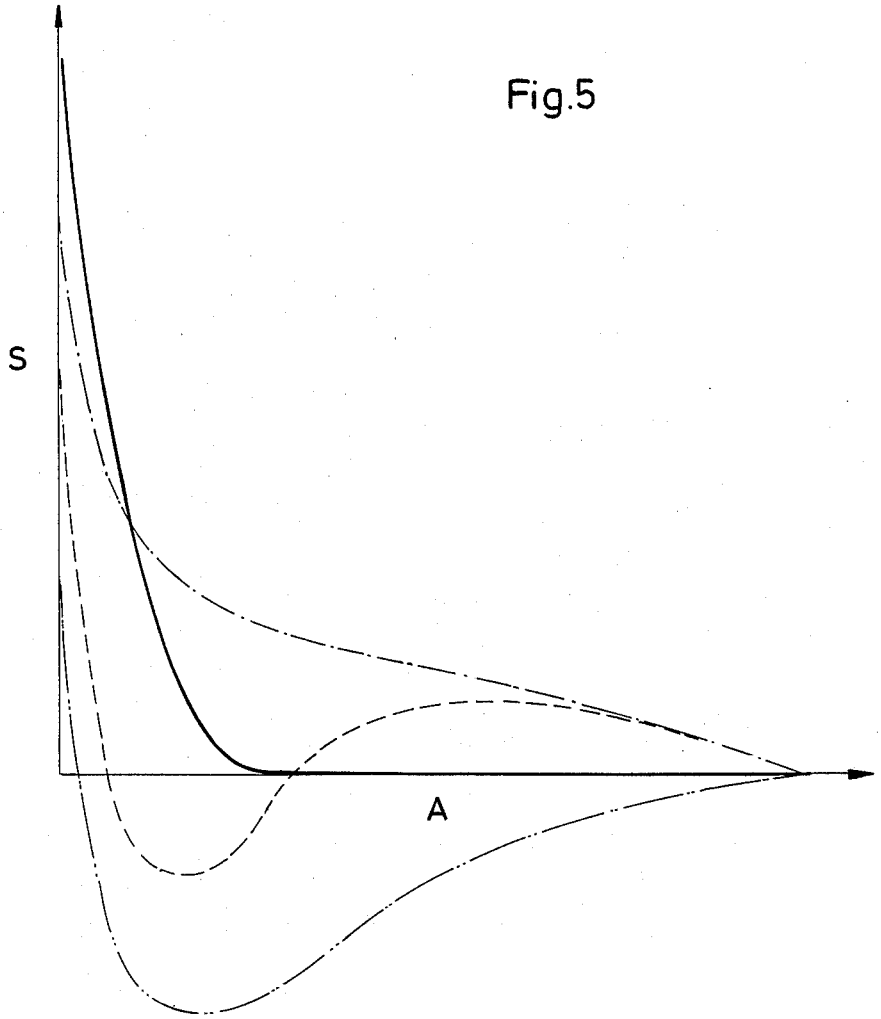
FIG. 5 illustrates a graph showing the pushing force curve for jet boxes according to FIG. 1 and 3 in comparison with conventional jet boxes.

Referring to FIG. 5, the continuous line represents the pushing force curve of a jet box 1, 11. The dot and dash line represents the pushing force curve of a jet box as described in German PS No. 1 774 126; the continuous line represents the pushing force curve of a jet box according to the invention; the dotted line which plunges into the negative range and the dash-double dot line represents the pushing force curves of jet boxes with and without jet holes at the edge of a guide surface which is opposite a slit-jet. The curves reflect measurements taken on a plane and rigid surface.

A comparison of the curves shows that the jet box according to this invention, which requires no greater but, on the contrary, rather less constructional outlay than the generically similar conventional boxes, affords a surprisingly great improvement in pushing force behavior.

Compared with the other jet boxes the pushing force generated by a jet box according to the invention is higher and rises more quickly in the vicinity of the guide surface whilst dropping rapidly to zero, without plunging into the negative range, in the direction away from the guide surface. This, on the one hand, provides an effective safeguard against potential contact engagement with the material in the region of the guide surface and, on the other hand, reduces flutter risk at the guide surface ends.

In FIG. 5, the pushing force S is plotted against the distance A along the surface of a jet box.

I claim:

1. A jet conveyor box for floatingly guiding a conveyed strip of material, said box having a slit-type jet having at least one orifice for ejecting propelling medium therefrom;

a guide surface adjoining said slit-type jet for guiding and directing the medium ejected through said jet, said guide surface including a substantially plane region adjacent said jet and a bent region disposed at an angle of from 30° to 60° relative to said plane region to define a bend therewith, said bent region being disposed on a side of said plane region opposite said jet; and a plurality of jet holes along said bend for ejecting additional propelling medium therefrom.

2. A jet conveyor box as set forth in claim 1 wherein said bent region defines an angle of 45° with said plane region.

3. A jet conveyor box as set forth in claim 1 wherein said jet holes have a cross-sectional area equal to one third the cross-sectional area of said slit.

4. A jet conveyor box as set forth in claim 1 wherein said jet has a width equal to from 1/20th to 1/10th of the distance between said jet and said jet holes.

5. A jet conveyor box as set forth in claim 1 wherein said jet includes a plurality of laterally disposed orifices.

6. A jet conveyor box as set forth in claim 1 which further has a second plurality of jet holes in said plane region and in staggered relation to the first plurality of jet holes.

7. A jet conveyor box as set forth in claim 6 wherein said jet holes have a cross-sectional area equal to one third the cross-sectional area of said slit.

8. A jet conveyor box as set forth in claim 6 wherein said jet has a width equal to from 1/20th to 1/10th of the distance between said jet and said jet holes.

9. A jet conveyor box as set forth in claim 1 further having a feed pipe for receiving a propelling medium, said feed pipe being disposed opposite said plane region.

10. In combination, a plurality of jet conveyor boxes, each said box having a slit-type jet having at least one orifice for ejecting propelling medium therefrom; a guide surface adjoining said slit-type jet for guiding and directing the medium ejected through said jet, said guide surface including a substantially plane region adjacent said jet and a bent region disposed at an angle of from 30° to 60° relative to said plane region to define a bend therewith, said bent region being disposed on a side of said plane region opposite said jet; and a plurality of jet holes along said bend for ejecting additional propelling medium therefrom; said boxes being disposed in longitudinally spaced relation on alternating sides of a conveying path, said plane regions of said boxes on one side of said path extending in a plane spaced a distance less than double the width of a jet from a corresponding plane on the other side of said path containing said plane regions of said boxes thereat, said boxes on opposite sides of said path being offset from each other a distance equal to one-half the spacing between said boxes on each side of said path.

11. A jet box for floatingly supporting strip and sheet material and having a flat plane guide surface adapted to face in a direction towards the material, the guide surface on one side edge portion thereof bending at an obtuse angle away from said direction so as to form a corner, means for jetting a flow of pressurized fluid transversely over said guide surface towards said corner, and means for ejecting fluid jets outwardly directly through said corner.

* * * * *